United States Patent [19]

Bridges

[11] Patent Number: 4,843,977

[45] Date of Patent: Jul. 4, 1989

[54] SHELF HAVING SELECTABLE ORIENTATIONS

[75] Inventor: John A. Bridges, Nashville, Tenn.

[73] Assignee: Aladdin Industries, Incorporated, Nashville, Tenn.

[21] Appl. No.: 552,095

[22] Filed: Nov. 16, 1983

Related U.S. Application Data

[63] Continuation-in-part of Ser. No. 458,210, Jan. 17, 1983, abandoned.

[51] Int. Cl.[4] ..... A47B 5/00

[52] U.S. Cl. ..... 108/152; 108/13; 211/90

[58] Field of Search ..... 108/13, 32, 107, 108, 108/135, 152; 211/90, 94, 135; 248/242; 312/209

[56] References Cited

U.S. PATENT DOCUMENTS

| | | | |
|---|---|---|---|
| 1,270,718 | 6/1918 | Ford | 108/13 X |
| 1,407,845 | 2/1922 | DeWitt | 211/90 X |
| 1,805,989 | 5/1931 | Levene | 108/107 |
| 3,029,056 | 4/1962 | Breglia . | |
| 3,129,819 | 4/1964 | Chandler | 108/152 X |
| 3,323,656 | 6/1967 | Weiss et al. | 108/152 X |
| 3,335,874 | 8/1967 | Levy et al. | 108/152 X |
| 3,381,636 | 5/1968 | Saiberlich | 108/152 |
| 3,425,568 | 2/1969 | Albright | 211/94 X |
| 3,437,214 | 4/1969 | Sainsbury | 108/152 X |
| 3,580,192 | 5/1971 | Davidson | 108/152 |
| 3,669,034 | 6/1972 | Marshak | 108/152 |
| 3,669,035 | 6/1972 | Grossman | 108/152 |
| 3,704,675 | 12/1972 | Bellasalma | 108/152 |
| 4,131,203 | 12/1978 | Bridges . | |
| 4,160,570 | 7/1979 | Bridges | 108/32 X |
| 4,165,852 | 8/1979 | Chervenak | 108/152 X |
| 4,203,373 | 5/1980 | Conti | 108/13 X |
| 4,320,935 | 3/1982 | Nagelkirk | 108/152 X |
| 4,407,476 | 10/1983 | Bohannan | 211/90 X |
| 4,437,712 | 3/1984 | Wissinger | 312/209 X |

FOREIGN PATENT DOCUMENTS

| | | | |
|---|---|---|---|
| 621152 | 8/1962 | Belgium | 108/108 |
| 1210395 | 3/1960 | France . | |
| 180011 | 7/1962 | Sweden | 248/242 |
| 658438 | 10/1951 | United Kingdom | 211/90 |
| 891247 | 3/1962 | United Kingdom | 108/107 |

*Primary Examiner*—James R. Brittain

*Attorney, Agent, or Firm*—Sandler & Greenblum

[57] ABSTRACT

A shelf adapted to be easily mounted to or removed from a vertical surface by a bracket has a generally L-shaped cross section defining a horizontal base portion and a vertical leg portion. A first mounting element is disposed on the leg portion adjacent the juncture of the leg portion and base portion for engaging the bracket. A second mounting element is disposed adjacent the distal edge of the leg portion for engaging the bracket wherein one of the first and second mounting mechanisms is engaged with the bracket and the other is engaged with the wall. When the second mounting element engages the bracket, the shelf has a generally L-shaped appearance and a generally inverted L orientation when the first mounting element engages the bracket whereby the orientation of the shelf is selectable. The bracket preferably includes a longitudinal channel which is coextensive with the shelf for supporting the latter.

17 Claims, 4 Drawing Sheets

SHELF HAVING SELECTABLE ORIENTATIONS

BACKGROUND OF THE INVENTION

The present application is a continuation-in-part of application Ser. No. 458,210, filed Jan. 17, 1983 and entitled: "Shelf Having Selectable Orientations", now abandoned.

The present invention is directed generally to shelving and is more specifically directed to shelving which is removably mounted on a vertical surface by separate mounting brackets.

In one common type of shelving, a board is horizontally mounted adjacent a wall by using spaced apart L-shaped mounting brackets. One leg of each bracket is secured contiguously to the wall such that the other leg extends perpendicular to the wall to receive the board. The board is attached to the projecting legs of the brackets with screws.

Another type of shelving uses two or more elongated metal strips mounted vertically to a wall. The strips include a plurality of slots for receiving metal support arms which extend perpendicular to the wall. A conventional board is supported by the arms.

The above described types of shelving have certain disadvantages. The mounting devices for holding the boards are readily seen and are generally not considered aesthetically pleasing. Also, such devices must be carefully aligned relative to each other to properly support the boards in a horizontal plane. The conventional boards used in such types of shelving only provide a planar support surface. In U.S. Pat. Nos. 4,131,203 and 4,160,570, wall mounted modules or bins are disclosed for storing and displaying merchandise. However, such modules can only be mounted in a single position.

SUMMARY OF THE INVENTION

It is the object of the present invention to provide an improved and novel shelf which overcomes the disadvantages of the above described shelves.

Another object of this invention is to provide a one piece shelf having a generally L-shaped cross section which includes mounting means permitting the shelf to be selectably mounted in an L orientation or an inverted L orientation.

A further object of the invention is to provide a shelf which can be easily and economically manufactured.

A still further object of the invention includes the integral formation of means for supporting a prepackaged product at an angle with respect to the horizontal to provide an effective visual display.

An object of the invention is to provide a novel shelving system including a wall mounting bracket and a shelf as described in the above objects of the invention.

An embodiment of the present invention includes an elongated extruded shelf having a generally L-shaped cross section defining a vertical leg portion and a horizontal base portion. First and second spaced apart mounting means are formed on the outside surface of the leg and are disposed so that either can selectively engage a separate wall mounted bracket to support the shelf in an L position or inverted position. A lip which may be formed adjacent the distal edge of the base cooperates with a leveled edge of the leg to provide a means for supporting and displaying a package at a predetermined viewing angle. The mounting bracket preferably includes a longitudinal channel for engaging one of the first and second mounting means.

BRIEF DESCRIPTION OF THE DRAWINGS

The invention itself is et forth in the claims which form a part of the specification. An embodiment of the present invention is described below with reference to the drawings in which FIG. 1 a perspective view of an embodiment of the shelving of the invention;

DETAILED DESCRIPTION

Figure 1:
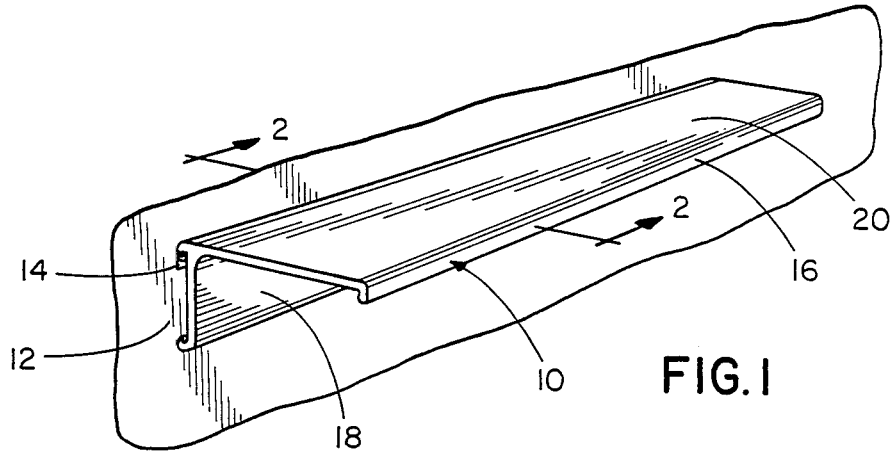
Figure 2:
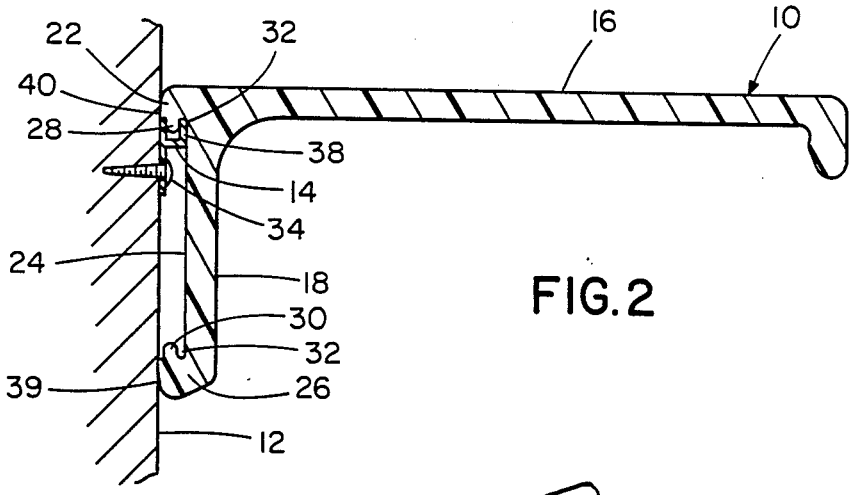
FIG. 2 cross sectional view taken along line 2—2 of FIG. 1.

Referring to FIGS. 1 and 2, a shelf 10 embodying the present invention is shown mounted on a wall or other vertical surface 12 in an inverted L configuration by means of a mounting bracket 14. The bracket is preferably coextensive with the length of the shelf to provide uniform support. The shelf 10 may be made from wood, a metal such as aluminum or a suitable plastic material such as a foamed thermoplastic and may be formed by extruding the metal or plastic material. Alternatively, the shelf may be fabricated by other methods as described herein. The shelf has a generally L-shaped cross section which includes a base portion 16 and a leg portion 18. The base portion defines a horizontal planar surface 20 suitable for supporting various articles.

In order to mount the shelf on a supporting surface in bracket engaging means, are provided in the embodiment illustrated, a projection 22 extending from the rearward side 24 of leg portion 18 generally at the juncture of the leg and base portions. Another projection 26 extends generally from the rearward side 24 of leg portion 18 at the distal edge of the leg portion. A bead 28 extends from projection 22 generally parallel to the leg portion toward a bead 30 which extends from projection 26 generally toward the bead 28. Each of these beads is spaced slightly outwards from the leg portion to define recesses 32 between the lips and the leg portion. In the embodiment illustrated, the projections 22 and 26 as well as beads 28 and 30 are preferably formed as a one piece structure with the leg and base portions. As may be seen in the drawings the wall contacting surfaces lie generally in the same plane.

As shown in FIGS. 1 and 2, the shelf 10 is attached to the wall by the engagement of bead 28 with the mounting bracket 14. The mounting bracket may consist of a longitudinal metal bracket having a plurality of spaced apart holes for receiving screws 34 (see FIG. 3) which attach the bracket to the wall. The bracket includes a means for receiving one of beads 28 and 30 and in the illustrated embodiment is formed as a channel 36 which may have a generally U-shaped cross section, facing upwardly when mounted. When a shelf is mounted on the bracket, a wall 38 of the channel 36 engages in one of the recesses 32 defined between beads 28 or 30 and the rearward wall 24 of the leg portion. The projections 22 or 26, as may be seen in the drawing, are provided with rearward or wall facing surfaces 39 or 40 lying generally in the same plane to engage wall 12 when the shelf is mounted to stabilize the base portion 16 in a horizontal plane, that is, perpendicular to vertical wall 12. As illustrated in the drawings, when the shelf is mounted in either "L" or inverted "L" position, one of the surfaces 39 or 40 will engage the wall at one end of the leg 18 so that the wall provides a fixed surface resisting any turning moment due to the weight of a shelf or an object on it.

In the illustrated embodiment, the beads 30 and 28 are preferably recessed inwardly from the surfaces 39 and 40 on the projections 22 and 24, respectively. Recessing the heads provides clearance for the channel 36 of the mounting bracket so that surfaces 39 and 40 may each engage the wall 12 to provide support as described. In addition, the projections 22 and 26 provide a continuation of the surface 20 and leg portion 18 substantially adjacent to wall 12 thereby concealing the mounting bracket 14 for aesthetic purposes. Thus, the mounting bracket cannot be seen by viewing the shelf from the top, front or bottom regardless of how the shelf is mounted.

Figure 3:
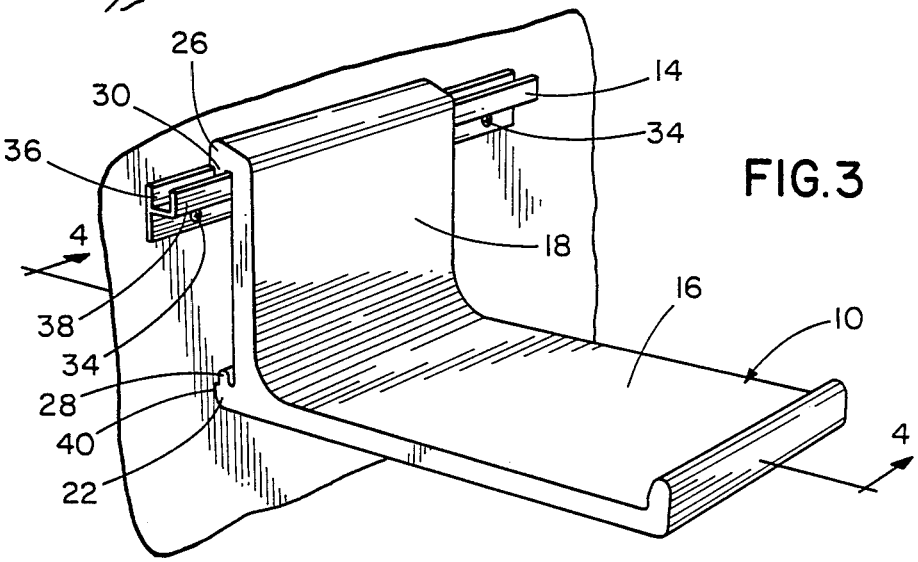
FIG. 3 is a perspective view of an embodiment of the present invention shown mounted in an alternative position.
Figure 4:
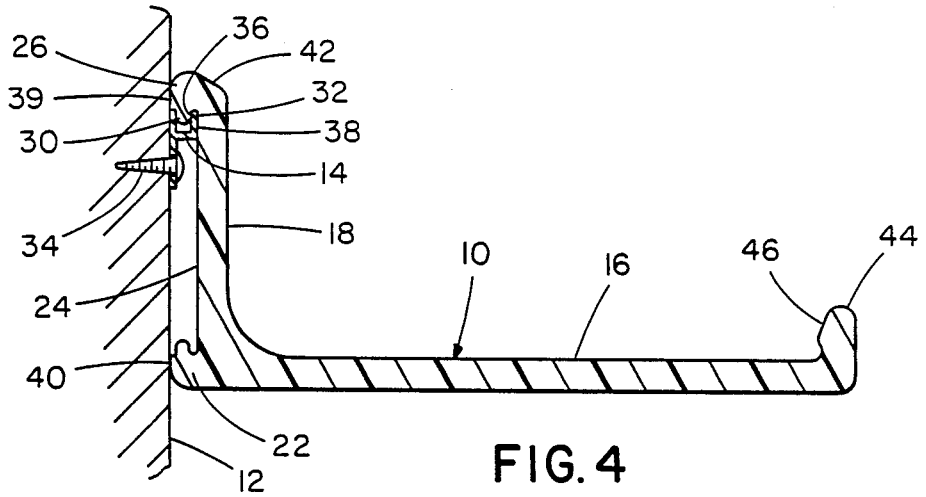
FIG. 4 is a cross sectional view taken along line 4—4 of FIG. 3.

FIGS. 3 and 4 illustrate the embodiment in FIGS. 1 and 2 of the present invention mounted in an L orientation. By comparing FIG. 4 with FIG. 2 it will be apparent that shelf 10 can be reversibly mounted to bracket 14, that is, it can be mounted either in an L orientation with base 16 extending horizontally below leg portion 18 or in an inverted L orientation wherein base 16 extends horizontally above the leg portion.

In the L orientation, the bead 30 engages in the channel 36 of the mounting bracket. The wall 38 of the mounting bracket is received by recess 32 defined between bead 30 and the rearward surface 24 of the leg portion 18. The surface 40 of projection 22 engages wall 12 to stabilize the shelf in a position wherein base 16 extends in an horizontal plane. Mounting bracket 14 is shown in FIG. 3 as extending longitudinally beyond the shelf in order to illustrate the configuration of the mounting bracket. However, it is contemplated that the shelf and mounting bracket be longitudinally coextensive so that the mounting bracket will be concealed from view.

The projection 26 defines a generally planar surface 42 which slopes towards the distal edge of base portion 16. A rim 44 may be provided to extend along the distal edge of the base portion 16. The rim projects generally perpendicular to the base portion on the same side of the base portion as the leg portion. A planar surface 46 on an inside area of rim 44 is preferably inclined such that a plane defining this surface is generally perpendicular to a plane defining surface 42. A similar rim may be provided to extend below the base portion.

Figure 5:
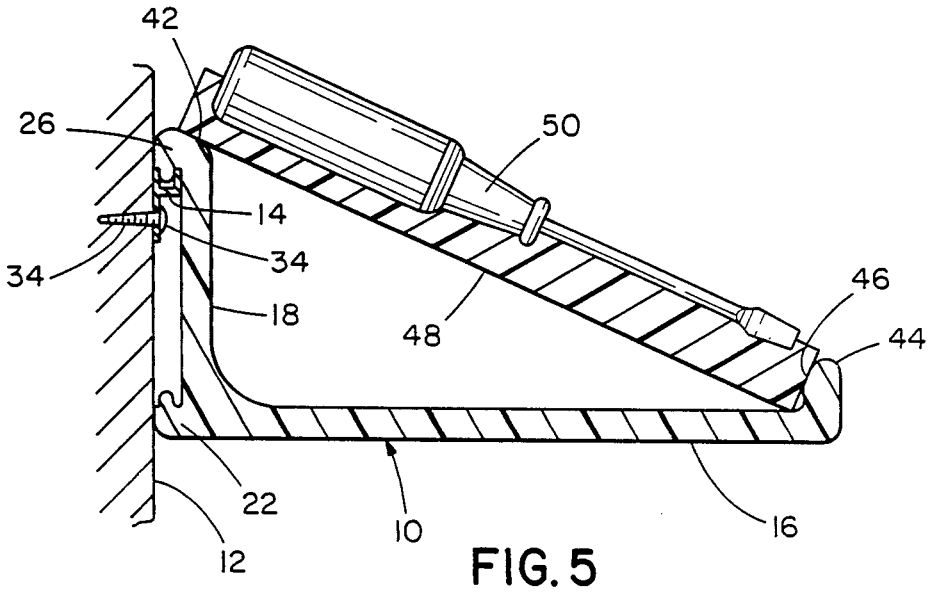
FIG. 5 is a cross sectional view similar to that of FIG. 4 package being supported by the shelf.

FIG. 5 illustrates that the shelf 10, when mounted in the L orientation, provides support for displaying merchandise. For example, a package 48 which contains an item to be displayed such as a screwdriver set 50 can be supported in an inclined position to provide a desirable viewing angle for the item 50. The elevated portion of package 48 is supported by surface 42. The lower edge of package 48 engages surface 46 which acts as an abutment to prevent the package from sliding off the distal end of base portion 16. Although shelf 10 can function as a display for packaged items, it is also suitable for holding a variety of objects which are prevented from falling off the shelf by rim 44.

In accordance with the invention, various forms of containers or article holders may be used in conjunction with the shelves. Thus, in addition to the package illustrated in FIG. 5, various items used for food storage, preparation and service, such as cannisters, knife holders, recipe files, etc. can be provided. Food serving containers such as insulated dish holders can be used. It is believed that wherever shelves find utility in the home, office, workshop or factory, shelving in accordance with the invention, alone or in combination with various forms of holders and containers, will be useful providing strength, versatility and a pleasing appearance.

Figure 6:
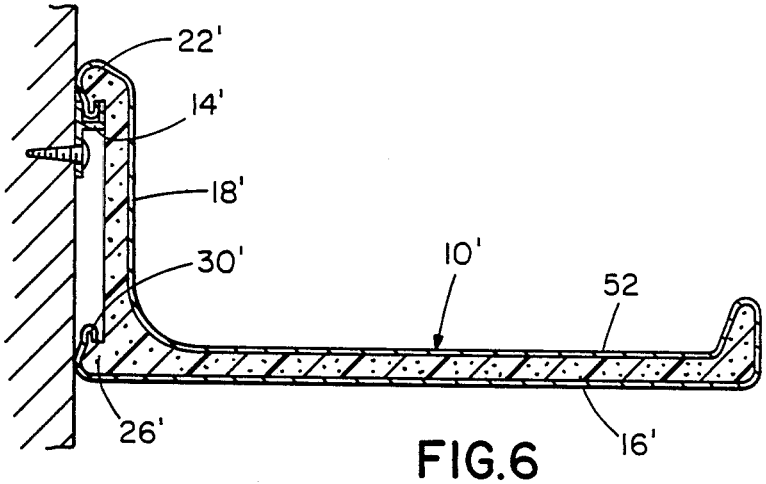
FIGS. 6—12 are cross sectional views of other embodiments of the invention.
Figure 7:
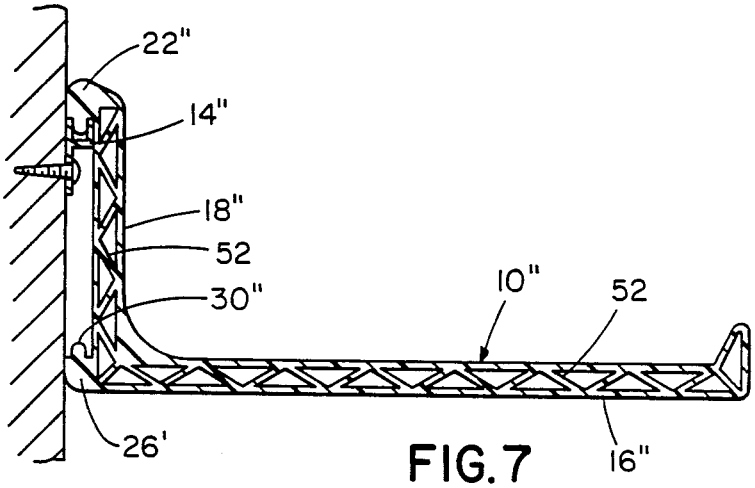
Figure 8:
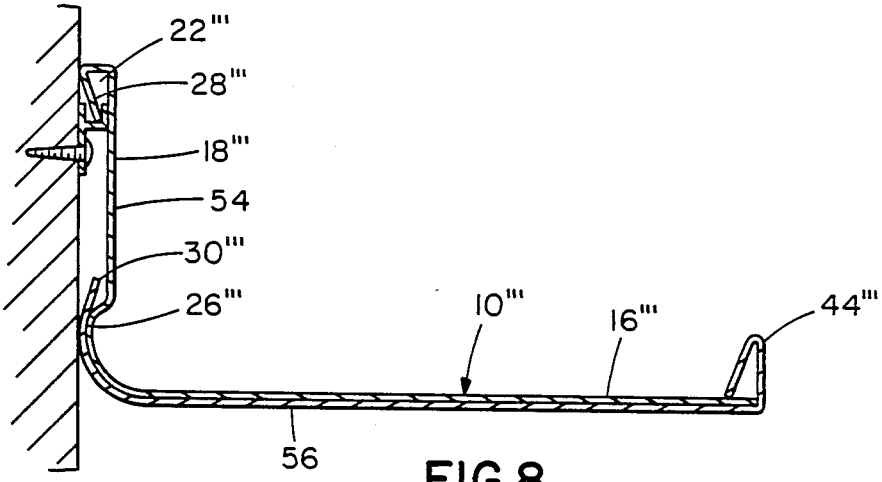

FIGS. 6 through 8 illustrate alternative embodiments of the invention. In these figures corresponding parts have been designated by the same reference numerals with each corresponding part designated with the reference numeral and a prime indicator for each of the three figures.

In the embodiment of FIG. 6, a shelf in accordance with the invention is formed by foaming a plastic material in a suitable mold and, if desired, a "skin" of plastic material may be provided. Alternatively, no skin need be provided if a self-skinning foam is used; however, a thin sheet metal covering may be used to provide a surface resisting scratches and other kinds of marks.

FIG. 7 illustrates a shelf formed by extruding plastic or aluminum which is relatively lightweight with the requisite physical strength being provided by forming a shelf as a hollow structure with internal braces 52 provided throughout the interior of the shelf.

In FIG. 8 the shelf is constituted by formed sheet metal, and in the illustrated embodiment a first piece of sheet metal 54 provides the upper surface of the base portion 16'''' and the leg portion 18''''. A second piece of sheet metal 56 provides the lower surface of the base portion 16'''' and is bent over the rim 44''''. The two pieces of metal may be joined to each other by the use of an adhesive, welding, or other suitable bonding technique.

Figure 9:
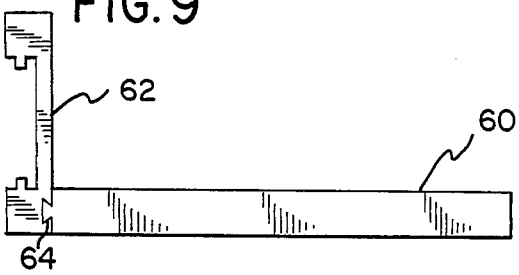

In FIG. 9 a shelf formed from wood is shown. In working with wood, it may be easier and more economical to make the shelf of two separate pieces, one 60 joined to other 62 by a dovetail joint 64 as shown..

Figure 10:
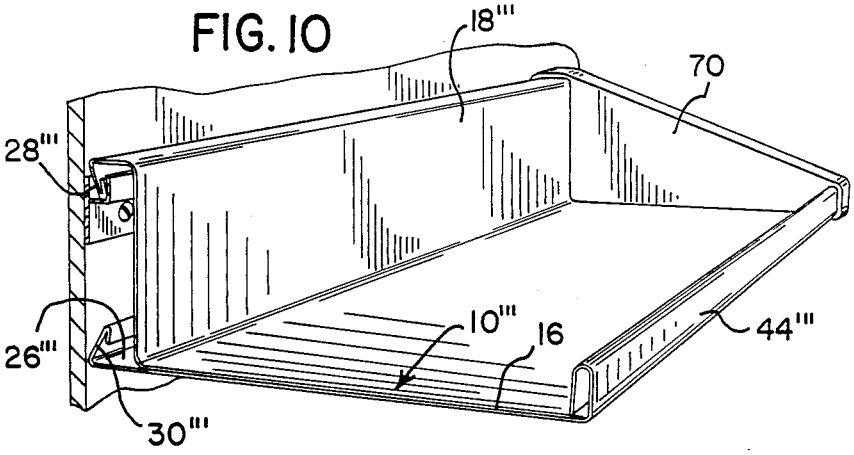
Figure 11:
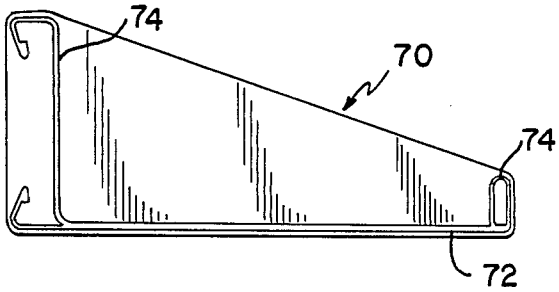

FIG. 10 illustrates an alternative form of metal construction where end caps are provided for both appearance and strength purposes. Those parts in the embodiment of FIG. 10 which correspond structurally, if not in exact shape, to the elements of FIG. 8, have been given the same reference numeral. Shown in this drawing is one end cap 70 engaging an end of the shelf along its back and front. FIG. 11 shows an end cap formed with a strengthening rib 72 along its bottom. The rib 72 is dimensioned to extend slightly under the leg of the shelf to add rigidity. Grooves 74 at opposite ends of the end cap are provided and the ends of the shelf engage relatively tightly therein to hold the ends on the shelves.

Figure 12:
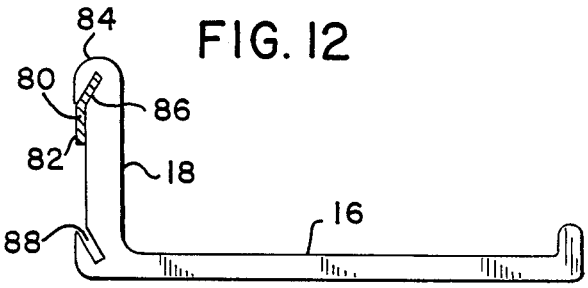

FIG. 12 illustrates still another embodiment of the invention. In this figure the base 16 is formed as before. However, the bracket reference numeral 80 is formed having a vertically extending portion 82 and an angled portion 84 extending away from a wall when the bracket is mounted thereon using any suitable fastening means. The portion 84 may engage in either an angled slot 86 or an angled slot 88 so, as before, the shelf may be mounted in an "L" or inverted "L" position. In both cases the back of the vertical leg 18 is recessed to accommodate the thickness of the bracket to conceal it when the shelf is mounted.

It will be apparent from the above description and the drawings that the shelf of the present invention provides several desirable features. For example, the shelf can be selectively mounted in one of two positions by merely hanging the shelf from the mounting bracket in the desired position. The shelf may be quickly and easily mounted to or removed from a wall. The same mounting bracket supports the shelf in either position. Regardless of whether the shelf is mounted in the L or inverted L position, the mounting bracket is hidden from view making for a more aesthetically pleasing installation. The one piece shelf of the present invention can be mounted to provide a conventional planar support surface or can be mounted to serve as a display support structure.

In addition to the materials and forms of fabrication discussed above, shelves according to the invention may be formed of polyurethane foam, resin impregnated pressed fibers, fiberglass or wood. In selecting a material, an important consideration, of course, is that it result in a shelf having the stiffness required for its particular application.

Although an embodiment of the present invention has been described above and illustrated in the drawings, the scope of the present invention is defined by the claims appended hereto.

What is claimed is:

1. A shelving system including a shelf and a bracket means for mounting said shelf to a wall, said shelf having a generally L-shaped cross section defining a horizontal base portion and a vertical leg portion, a first mounting means disposed on said leg portion adjacent to the juncture of the leg portion and base portion for engaging said bracket means, and a second mounting means disposed adjacent the distal edge of said leg portion for engaging said bracket means, one of said first and second mounting means being engaged with said bracket means and the other being in engagement with said wall, said shelf having a general L orientation when said second mounting means engages said bracket means, said shelf having an inverted L orientation when said first mounting means engages said bracket means, whereby the orientation of the shelf is selectable.

2. The shelving system according to claim 1 wherein said bracket means comprises a continuous longitudinal bracket having a channel means formed as part of said bracket for receiving said one of said first and second mounting means of said shelf.

3. The shelving system according to claim 2 wherein said bracket is longitudinally coextensive with said shelf.

4. A shelf adapted to be releasably mounted to a supporting surface by engagement with a bracket having an upwardly directed opening, said shelf having a generally L-shaped cross section comprising a horizontally extending base portion and a vertical leg portion, a first mounting means adjacent the juncture of said leg portion and said base portion having a portion extending generally along said vertical leg portion for engagement in the bracket opening, a second mounting means adjacent the distal end of said leg portion for engagement in the bracket opening whereby the shelf can be mounted on said supporting surface with said first mounting means engaging in the bracket opening and said second mounting means contacting said supporting surface to have an inverted L orientation or with said second mounting means engaging in the bracket opening and said second mounting means engaging said supporting surface to have an L orientation to provide selectable orientations.

5. A shelf according to claim 4 wherein said mounting means each have portions spaced from said vertical leg portion extending generally along said vertical leg portion to provide a space between each of said mounting means and said vertical leg portion into which a portion of bracket can be engaged.

6. A shelf according to claim 5 wherein said portions of said mounting means extend generally toward each other.

7. A shelf according to claim 4 wherein each of said mounting means are coextensive with the longitudinal extension of the shelf to provide support throughout its length.

8. A shelf as set forth in claims 4, 5, 6, or 7 wherein said first and second mounting means extend from a side of said leg portion opposite to that from which said horizontal base portion extends.

9. A shelf as set forth in claim 8 wherein heads are provided on each mounting means extending therefrom toward each other.

10. A shelf according to claim 9 wherein said base portion, vertical leg portion and said first and second mounting means are formed as a one piece structure from a plastic material.

11. A shelf according to claim 9 wherein said base portion, vertical leg portion and said first and second mounting means are all integrally formed as a once piece structure from a metallic material.

12. The shelf according to claim 9 further comprising a rim formed adjacent the distal edge of said base portion, said rim extending from said base portion on the same side as said leg portion.

13. The shelf according to claim 12 further comprising a planar surface which extends longitudinally along said second mounting means, said planar surface sloping generally towards the distal edge of said base portion, wherein said rim and planar surface cooperates to define a display means for supporting a package at an angle relative to the horizontal.

14. The shelf according to claim 13 wherein said rim defines a planar surface in a plane generally perpendicular to a plane defining said planar surface of said second mounting means, whereby said planar surface of said rim serves to abut a lower edge of said package.

15. A shelf adapted to be releasably mounted to a supporting surface by engagement with a bracket having an upwardly directed opening, said shelf comprising generally an L-shaped cross section comprising a horizontally extending base portion having an upper surface and a lower surface, a vertical leg portion extending at substantially a right angle to said base portion, a first mounting means comprising a first projection extending from the junction of said base portion and said vertical leg portion in a direction opposite to that of said base portion and a first bead extending from said first projection toward the distal end of said leg and terminating inwardly of the end of said projection for engagement in the bracket and when so engaged the outer surface of said first projection contacts the supporting surface, a second mounting means comprising a second projection extending from the distal end of said vertical leg portion and a second bead extending from said second projection toward said first bead extending from said first projection of said first mounting means and terminating inwardly of the ends of said second projection for engagement in the bracket and when so engaged the outer surface of said second mounting means second projection contacts the supporting surface whereby the shelf can be mounted on said supporting surface with said first mounting means engaging in the bracket and said outer surface of said second mounting means contacting said supporting surface below said bracket to have an inverted L orientation with one surface of said horizontally extending base portion providing the shelf article supporting surface or with said second mounting means engaging in the bracket and said outer surface of first mounting means contacting said supporting surface to have an L-shaped orientation with the other surface of said horizontally extending base portion providing the article supporting surface.

16. A shelf according to claim 15 wherein said base portion, vertical portion and said first and second mounting means are formed as a one piece structure from a plastic material.

17. A shelf according to claim 15 wherein said base portion, vertical leg portion and said first nd second mounting means are all integrally formed as a one piece structure from a metallic material.

* * * * *